US006516175B2

(12) United States Patent
Ogasawara

(10) Patent No.: US 6,516,175 B2
(45) Date of Patent: Feb. 4, 2003

(54) COLOR IMAGE FORMING APPARATUS AND DEVELOPING METHOD FOR COLOR IMAGE FORMING APPARATUS

(75) Inventor: Masato Ogasawara, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/897,439

(22) Filed: Jul. 3, 2001

(65) Prior Publication Data

US 2003/0007809 A1 Jan. 9, 2003

(51) Int. Cl.[7] ..... G03G 15/01
(52) U.S. Cl. ..... 399/298; 399/223; 399/303
(58) Field of Search ..... 399/149, 150, 399/298, 303, 94, 223, 299

(56) References Cited

U.S. PATENT DOCUMENTS 5,515,155 A * 5/1996 Folkins ..... 399/223
5,765,087 A 6/1998 Yano et al. ..... 399/344
5,907,758 A * 5/1999 Tanaka et al. ..... 399/303
6,006,055 A * 12/1999 Furuya ..... 399/149
6,021,286 A * 2/2000 Kawai et al. ..... 399/299 X
6,029,033 A * 2/2000 Kawasaki ..... 399/149
6,031,629 A * 2/2000 Shibuya et al. ..... 399/94 X
6,321,059 B1 * 11/2001 Tamura ..... 399/149 X
6,365,316 B1 * 4/2002 Stamp et al. ..... 430/111.41

FOREIGN PATENT DOCUMENTS

JP 9-236962 9/1997

* cited by examiner

*Primary Examiner*—Fred L. Braun
(74) *Attorney, Agent, or Firm*—Foley & Lardner

(57) ABSTRACT

A color image forming apparatus and method includes a plurality of recording medium arranged along a conveying path for forming electrostatic latent images, a plurality of developing units installed respectively in the neighborhood of the plurality of recording medium for feeding developers having different lightness to the respective electrostatic latent images formed on the plurality of recording medium and forming developed images a plurality of transfer units for multiple-transferring the developed images formed respectively on the plurality of recording medium sequentially on a material to be transferred which is conveyed along the conveying path, and a plurality of collectors for collecting the respective residual developers on the plurality of recording medium after passing the transfer units in the plurality of developing units respectively. Among the plurality of developing units, the developing unit having the developer with lowest lightness compared with the developing unit having the developer with highest lightness are sequentially installed in the neighborhood of the recording medium from an upstream side to a downstream side of the conveying path.

5 Claims, 6 Drawing Sheets

COLOR IMAGE FORMING APPARATUS AND DEVELOPING METHOD FOR COLOR IMAGE FORMING APPARATUS

BACKGROUND OF THE INVENTION

1. Field of the Invention

The present invention relates to a color image forming apparatus and a development method for the color image forming apparatus for forming developed images in different colors on a plurality of photosensitive drums using developing units having different-colored developers respectively, obtaining a color image by multiple-transfer of color-superimpostion of the different-colored developed images on a paper sheet, collecting the respective developers remaining on the photosensitive drums in the respective developing units after end of transfer, and recycling them.

2. Description of the Related Art

Among color image forming apparatuses such a copying machine of an electrophotographic type and a printer, as a one for speedup of image forming, a color image forming apparatus, for example, of a two-piece tandem type is known that a plurality of image forming stations are arranged along the conveying path so as to form images for each color, and developed images in different colors respectively are formed on the photosensitive drums at the respective image forming stations, and a color image is obtained by executing multiple-transfer of sequential color superimposition of developed images in different colors on a paper sheet to be conveyed on the conveying path in synchronization with each developed image.

Conventionally, in such a color image forming apparatus of a tandem type, a phenomenon occurs that at an image forming station on the downstream side of the conveying path, at the time of multiple-transfer of a developed image on a paper sheet on which a developed image is transferred already on the upstream side, a part of the developed image formed at the image forming station on the upstream side is reversely transferred from the paper sheet onto the photosensitive drum side. Therefore, at the image forming station on the downstream side of the conveying path, the developer at the image forming station on the upstream side is mixed in the residual toner on the photosensitive drum after end of transfer.

Therefore, when the residual toner cleaned and removed is recycled, the original color cannot be obtained due to mixture of the developers and the display dignity of color images is lowered. Therefore, in a color image forming apparatus of a tandem type, conventionally, the residual toner on the photosensitive drums after end of transfer is removed by a cleaning unit without recycling it, then collected in a waste toner box, and disposed of by a user periodically after the waste toner box becomes full.

However, from the viewpoint of profitability of cost reduction by saving of toner consumption and from the viewpoint of environmental protection countermeasures such as practical use of resources and reduction in industrial wastes, recycling of toner has been desired recently.

On the other hand, a color image forming apparatus for collecting toner remaining on a photosensitive drum in a developing unit after end of transfer and recycling it is disclosed in Japanese Patent Application Laid-Open 9-236962. However, this color image forming apparatus for recycling toner originally uses a single photoconductor, forms a developed image in an optional color for each rotation of the photoconductor, and superimposes the color on a transfer paper, so that forming of a color image requires a lot of time and the color image forming apparatus is not suited to speedup. Further, the residual toner after transfer is collected from the photoconductor surface once by a cleaning member and then adhered again into the area independent of image forming on the photoconductor, thus the residual toner readhered onto the photoconductor is collected in the developing unit. Therefore, it is necessary to install an area for readhering the residual toner on the photoconductor and execute a residual toner readhesion process for the photoconductor separately from the developed image forming process, so that miniaturization of the photoconductor and speedup of the process will be prevented.

Therefore, in a color image forming apparatus of a tandem type for speeding up the color image forming process, it is desirable to collect residual toner without preventing speedup of the image forming process, obtain a good color image without reduction in the display dignity due to mixture of developers at the time of recycling of the collected residual toner, decrease the running cost, and contribute to environmental protection countermeasures.

SUMMARY OF THE INVENTION

An object of the present invention is to provide a color image forming apparatus of a tandem type for recycling residual toner without reduction in the display dignity, decreasing the cost, and contributing to environmental protection countermeasures.

Another object of the present invention is to provide a color image forming apparatus of a tandem type for collecting and recycling residual toner without reducing the process speed.

According to the present invention, a color image forming apparatus is provided, and the apparatus is composed of a plurality of recording medium arranged along a conveying path for forming electrostatic latent images, a plurality of developing units installed respectively in the neighborhood of the plurality of recording medium for feeding developers having different lightness to the respective electrostatic latent images formed on the plurality of recording medium and forming developed images, a plurality of transfer units for multiple-transferring the developed images formed respectively on the plurality of recording medium sequentially on a material to be transferred which is conveyed along the conveying path, and a plurality of collectors for collecting the respective residual developers on the plurality of recording medium after passing the transfer units in the plurality of developing units respectively, and among the plurality of developing units, the developing unit having the developer with lowest lightness compared with the developing unit having the developer with highest lightness is installed in the neighborhood of the recording medium arranged on the downstream side of the conveying path.

Further, according to the present invention, a color image forming apparatus is provided and the apparatus is composed of a plurality of recording medium arranged along a conveying path for forming electrostatic latent images, a plurality of developing units installed respectively in the neighborhood of the plurality of recording medium for electrostatically feeding developers having different lightness to the respective electrostatic latent images formed on the plurality of recording medium, forming developed images, and electrostatically collecting residual developers adhered to the recording medium, and a plurality of transfer units for multiple-transferring the developed images formed respectively on the plurality of recording medium sequentially on a material to be transferred which is conveyed along the conveying path.

Further, according to the present invention, a color image forming apparatus is provided and the apparatus is composed of a plurality of recording medium arranged along a conveying path for forming electrostatic latent images, a plurality of developing units installed respectively in the neighborhood of the plurality of recording medium for feeding developers having different lightness to the respective electrostatic latent images formed on the plurality of recording medium and forming developed images, a plurality of transfer units for multiple-transferring the developed images formed respectively on the plurality of recording medium sequentially on a material to be transferred which is conveyed along the conveying path, cleaning members for removing the respective residual developers on the plurality of recording medium after passing the transfer units, and additionally a plurality of collectors having developer conveying members for conveying the residual developers removed by the cleaning members to the plurality of developing units.

Further, according to the present invention, a developing method for a color image forming apparatus is provided, and the method is composed of a developing step of electrostatically feeding developers having different lightness respectively to electrostatic latent images formed on a plurality of recording medium arranged along a conveying path using developing members and forming developed images, a transfer step of multiple-transferring the developed images on the plurality of recording medium sequentially on a material to be transferred which is conveyed along the conveying path, and a collection step of electrostatically collecting the residual developers remaining on the plurality of recording medium using the developing members after ending of the transfer step, and the developing step is executed for the recording medium arranged on the upstream side of the conveying path using the developer with highest lightness, and the developing step is executed for the recording medium arranged on the downstream side of, the conveying path using the developer with lowest lightness.

Further, according to the present invention, a developing method for a color image forming apparatus is provided, and the method is composed of a developing step of electrostatically feeding developers having different lightness respectively to electrostatic latent images formed on a plurality of recording medium arranged along a conveying path using developing members and forming developed images, a transfer step of multiple-transferring the developed images on the plurality of recording medium sequentially on a material to be transferred which is conveyed along the conveying path, and a collection step of removing the residual developers remaining on the plurality of recording medium using cleaning members after ending of the transfer step and additionally conveying the residual developers removed toward the developing members, and the developing step is executed for the recording medium arranged on the upstream side of the conveying path using the developer with highest lightness, and the developing step is executed for the recording medium arranged on the downstream side of the conveying path using the developer with lowest lightness.

Figure 8:
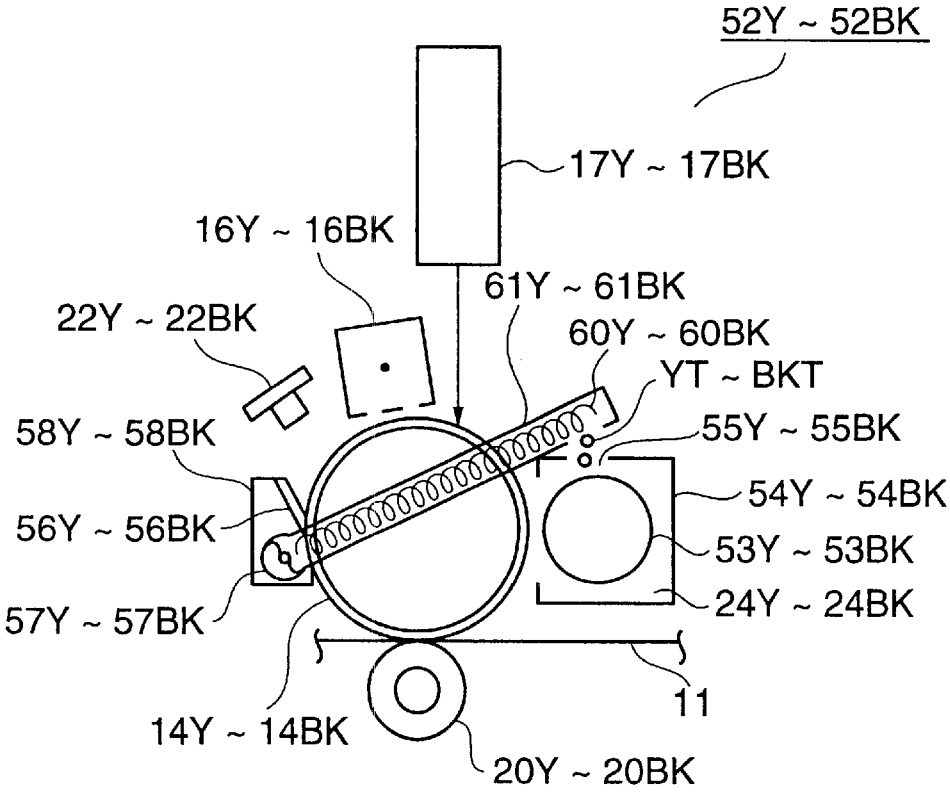
Figure 7:
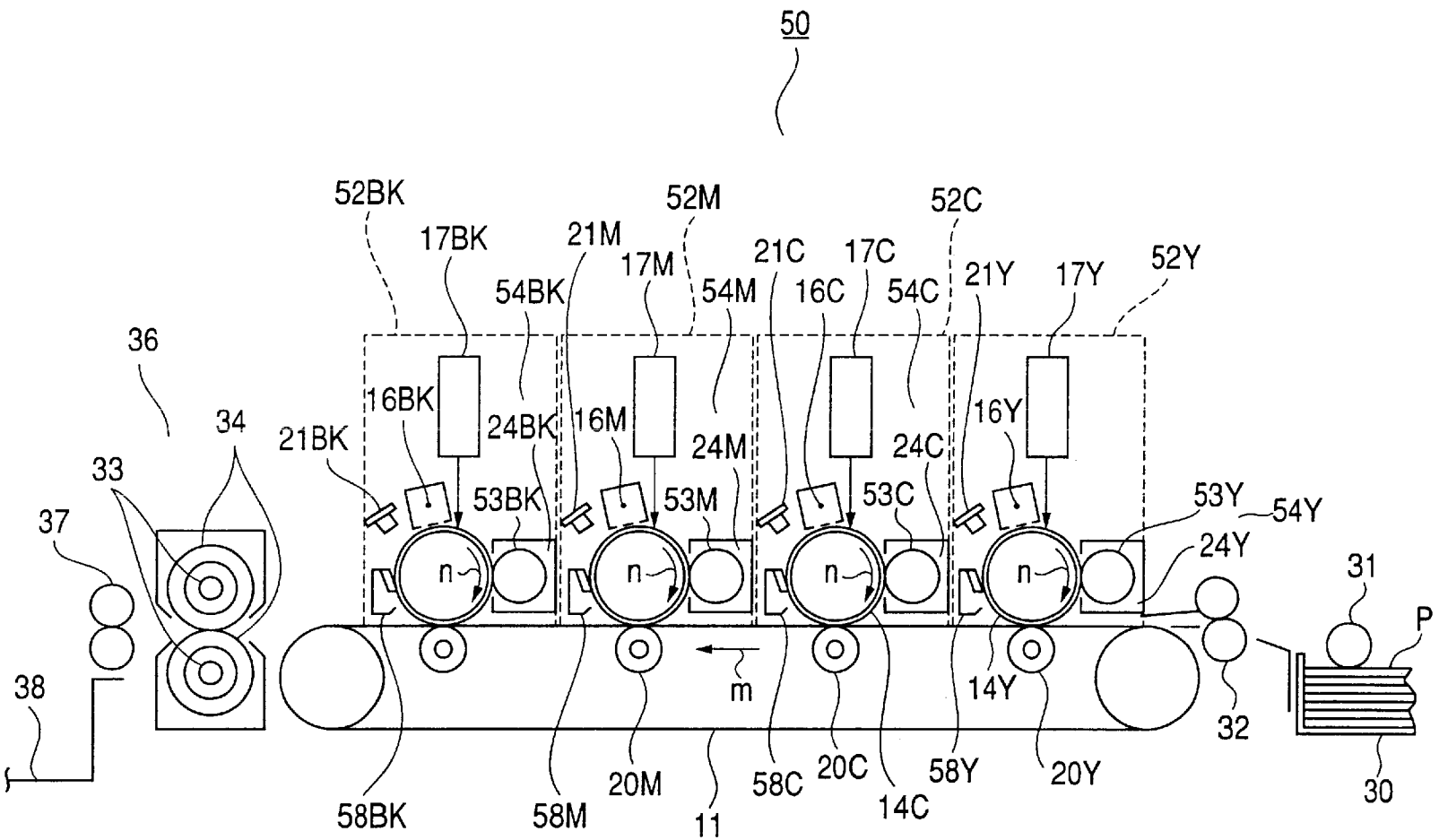

FIG . 6 is an illustration schematically showing the collection process of residual toner of the first embodiment of the present invention;

FIG. 7 is a schematic block diagram showing the image forming unit of the image forming apparatus of the second embodiment of the present invention; and FIG. 8 is a schematic block diagram showing the image forming station of the second embodiment of the present invention.

DETAILED DESCRIPTION OF THE PREFERRED EMBODIMENTS

Figure 1:
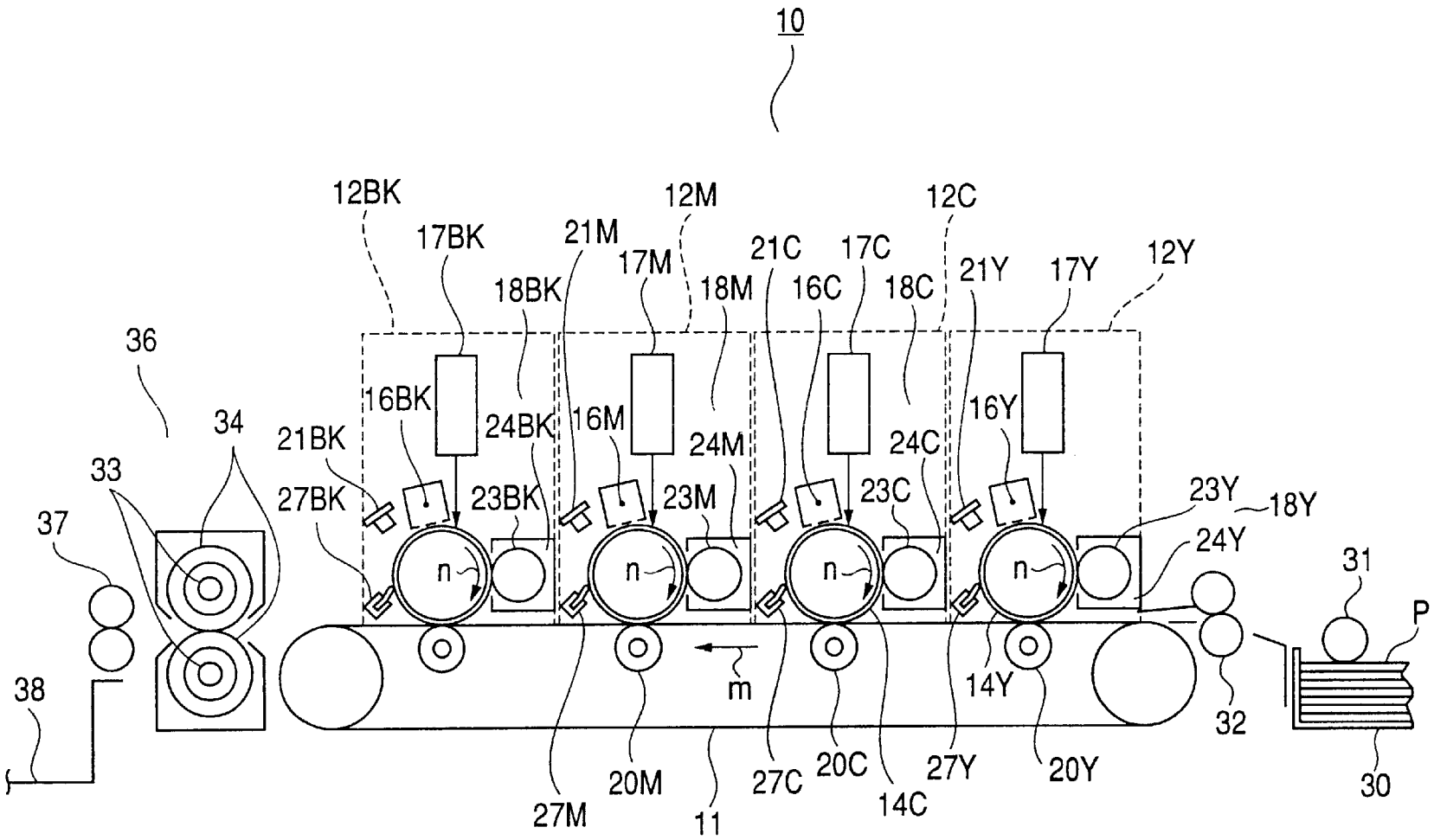
FIG. 1 is a schematic block diagram showing the image forming unit of the image forming apparatus of the first embodiment of the present invention.

The preferred embodiments of the present invention will be explained in detail hereunder with reference to the accompanying drawings. FIG. 1 is a schematic block diagram showing the image forming unit of the color image forming apparatus 10 of a 4-piece tandem type of the first embodiment of the present invention. In the color image forming apparatus 10, a full color image is formed using 4-color developers of yellow (Y), cyan (C), magenta (M), and black (BK).

When residual toner after transfer is collected by the color image forming apparatus 10 of a 4-piece tandem type and recycled by the developing units again, the developers are mixed. Therefore, the effect of mixture of developers on the display dignity is examined first. The occurrence of color mixture is caused by the reverse transfer of toner that the charge of a part of the toners transferred on a paper sheet already at the image forming station on the upstream side of the conveying path is inverted by supply of a charge from the transfer unit at the time of transfer of the developing image on the paper sheet and the charge-inverted toner is electrostatically sucked in the non-exposure portion of the photosensitive drum at the image forming station on the downstream side of the conveying path. By this reverse transfer phenomenon of toner, at all the image forming stations on the downstream side except the image forming station on the uppermost-stream side of the conveying path, mixture of toner derived from the image forming station on the upstream side is caused.

Then, the occurrence condition of this reverse transfer phenomenon of toner is examined and it is found that the reverse transfer amount of toner derived from the image forming station on the upstream side at each image forming station on the downstream side is almost the same independently of the color kind of each developer. The reason is that the reverse transfer phenomenon does not depend on the developer kind but is caused by electrostatic adhesion of toner to the non-exposure portion of each photosensitive drum of the image forming stations on the downstream side.

Further, it is found that with respect to the reverse transfer amount of toner, about 80% of toner developed and adhered to each photosensitive drum at the image forming stations on the upstream side is transferred to a paper sheet and further, about 5% of the transferred toner is sucked by reverse transfer on the non-exposure portion of each photosensitive drum of the image forming stations on the downstream side. Namely, 4% (0.8×5%) of the toner developed on each photosensitive drum of the image forming stations on the upstream side is sucked in the non-exposure portion of each photosensitive drum of the image forming stations on the downstream side and collected by the developing units of the image forming stations on the downstream side, thus color mixture is caused.

On the other hand, developers of four colors of yellow (Y), cyan (C), magenta (M), and black (BK) are prepared by adjusting the pigment kind and pigment content so that the developers of four colors are almost the same in consumption when prints at the same print rate are output and balanced color arrangement can be visually obtained when full color prints are output. The respective colors are fixed on a TFC paper (brand name, manufactured by Nihon Seishi, Ltd.) by solid printing and the lightness (L*) is measured by the CIE color specification system L*/a*/b* using the measuring instrument CR-200 manufactured by Minolta, Ltd. As a result, L*/a*/b* of yellow (Y) is (88.05/–12.64/85.05), and that of cyan (C) is (51.15/–16.36/–43.92), and that of magenta (M) is (46.92/65.81/11.69), and that of black (BK) is (25.11/0.52/0.31). Therefore, it is found that among the developers of four colors, the highest lightness is (88.05) of yellow (Y), and the lightness lowers in the order of (51.15) of cyan (C) and (46.92) of magenta (M), and the lowest lightness is (25.11) of black (BK).

Next, 6.5 wt % of toner in each base color is prepared, and 0.5 wt % of toner in another color is added on the assumption of color mixture, thus a developer with a toner content of 7.0 wt % in total is prepared. Since developers in four colors in total are used, 12 kinds of combinations of a base color and another color on the assumption of color mixture are obtained. Developed images are formed using these 12 combination kinds of developers and evaluated. As a result, a developer that mixed toner is most felt as a noise by a human sense is a one that black (BK) toner is mixed with yellow (Y) toner as a base. On the other hand, it is found that a developer that mixed toner is most hardly felt as a noise is a one that yellow (Y) toner is mixed with black (BK) toner as a base.

The image evaluation result of these 12 kinds of mixed developers shows that a developer that mixed toner is felt as a noise by a human sense is a one that the lightness of the base toner is high and the lightness of the mixed toner is low and as the difference in lightness increases, a noise is more strongly felt. On the other hand, it is found that a developer that mixed toner is hardly felt as a noise by a human sense is a one that the lightness of the base toner is low and the lightness of the mixed toner is high and as the difference in lightness increases, a noise is more hardly felt.

Therefore, it is found that when developers in four colors of yellow (Y), cyan (C), magenta (M) , and black (BK) are used, and toner is recycled, and full-color images are obtained by the 4-piece tandem system, to obtain full-color images that a noise is hardly felt by a human sense regardless of toner mixture and high display dignity to look at is realized, it is preferable to arrange yellow (Y) having highest lightness at the first image forming station on the uppermost stream side in the conveying direction, then arrange cyan (C) and magenta (M) sequentially at the second and third image forming stations, and arrange black (BK) having lowest lightness at the fourth image forming station on the lowermost stream side in the conveying direction.

On the basis of the above result, in the color image forming apparatus 10 of the first embodiment of the present invention shown in FIG. 1, first to fourth image forming stations 12Y, 12C, 12M, and 12BK for forming a developed image for each color component using each toner of yellow (Y), cyan (C), magenta (M), and black (BK) are sequentially arranged starting from the upstream side in the conveying direction of the arrow m along a transfer conveyor belt 11 which is a conveying path.

The respective image forming stations 12Y, 12C, 12M, and 12BK have the same constitution, so that the present invention will be explained by referring to the first image forming station 12Y of yellow (Y) arranged on the uppermost stream side of the transfer conveyor belt 11, and for the other image forming stations 12C, 12M, and 12BK, the same numerals and suffixes indicating the respective colors are assigned to the same parts and the explanation thereof will be omitted.

The first image forming station 12Y has a photosensitive drum 14Y which is a recording medium and around it, along the rotational direction thereof, a charging unit 16Y for charging the surface of the photosensitive drum 14Y for forming electrostatic latent images uniformly at about –600 V and an exposure unit 17Y for irradiating an optical signal corresponding to a yellow (Y) image are arranged sequentially. Further, around the photosensitive drum 14Y, a developing unit 18Y, a transfer roller 20Y to which a transfer bias of positive polarity is impressed by a power source 19Y, an auxiliary cleaning unit 21Y to which a bias of positive polarity is impressed, and a discharging unit 22Y are arranged sequentially. The transfer roller 20Y is arranged opposite to the photosensitive drum 14Y via the transfer conveyor belt 11.

The developing unit 18Y has a developing roller 23Y which is a developing member to which a developing bias of about –450 V is impressed and a developer 24Y of yellow (Y) containing toner YT of yellow (Y) having lightness (L*) of (88.05) measured by the CIE color specification system. The developing roller 23Y feeds the toner YT of yellow (Y) electrostatically to an electrostatic latent image on the photosensitive drum 14, forms a developed image, and electrostatically collects residual toner remaining on the photosensitive drum 14 after transfer. The developing units 18C to 18BK at the second to fourth image forming stations 12C to 12BK have developers 24C, 24M, and 24BK of cyan (C), magenta (M), and black (BK) containing toner of cyan (C), magenta (M), and black (BK) respectively having lightness (L*) of (47.76), (46.92), and (25.11) measured by the CIE color specification system and developed images composed of respective toners are formed on the photosensitive drums 14C to 14BK by the developing rollers 23C to 23BK.

In the auxiliary cleaning unit 21Y, to a conductive brush 27Y which is formed in a brush shape with conductive rayon and supported by a holder sheet metal 26Y, a bias is impressed by a power supply 28Y of positive polarity.

Further, on the upstream side of the first image forming station 12Y, a paper feed cassette unit 30 for housing paper sheets P which are members to be transferred, a pickup roller 31 for taking out a paper sheet P, and register rollers 32 for feeding the paper sheet P taken out from the paper feed cassette unit 30 to the transfer conveyor belt 11 in exact timing are arranged. The conveying speed of the paper sheets P by the register rollers 32 and the transfer conveyor belt 11 is set so as to be equal to the peripheral speed of the photosensitive drums 14Y, 14M, 14C, and 14BK.

On the downstream side of the transfer conveyor belt 11, a fixing unit 36 composed of a pair of upper and lower heat rollers 34 having a built-in heater 33 respectively, a pair of paper ejection rollers 37, and a paper ejection tray 38 are arranged.

Next, the operation will be described. When the image forming process starts, according to image data input from a scanner not shown in the drawing, developed images in the respective colors are formed at the image forming stations 12Y to 12BK. Namely, for example, at the first image forming station 12Y of yellow (Y), the image forming step is sequentially executed on the photosensitive drum 14Y according to the rotation in the direction of the arrow n and the drum is uniformly charged with about −600 V by the charging unit 16Y first. Next, on the photosensitive drum 14Y uniformly charged, exposure scanning is executed by the exposure unit 17Y, and the potential of the part of the surface of the photosensitive drum 14 irradiated with exposure light such as laser light is lowered to about −100 V, and an electrostatic latent image corresponding to the image data of yellow (Y) on the photosensitive drum 14Y is formed.

Figure 2:
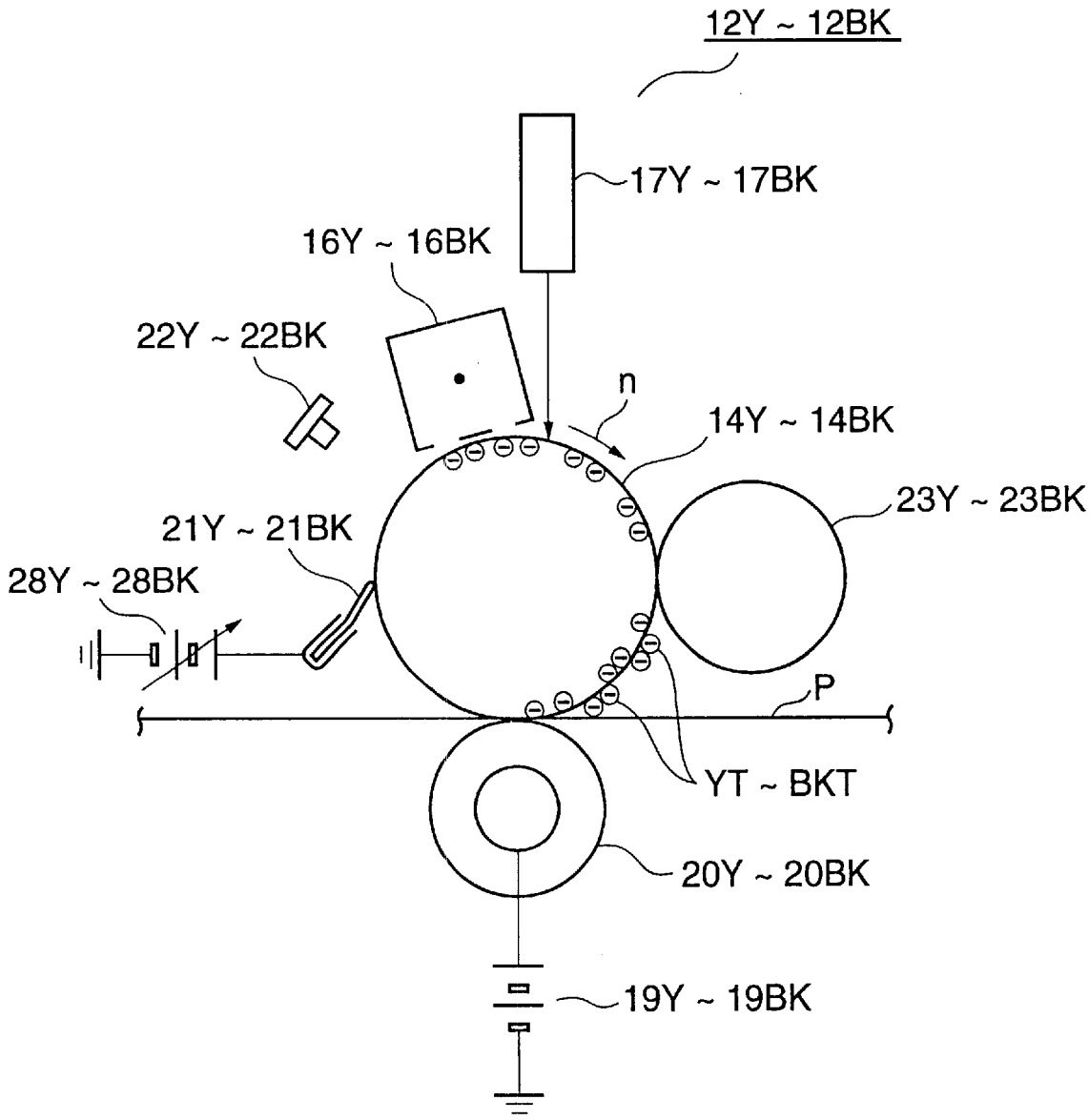
FIG. 2 is an illustration schematically showing the developing process at the image forming station of the first ,embodiment of the present invention.

When the electrostatic latent image reaches the developing unit 18Y, as shown in FIG. 2, the toner YT of yellow (Y) of negative polarity is electrostatically adhered to the exposure light irradiated part where the potential of the surface of the photosensitive drum 14Y is lowered to about −100 V from the developing roller 23Y and a developed image is formed. In the same way as this, at the image forming stations 12C to 12BK of magenta (M), cyan (C), and black (BK), developed images in the respective colors are formed on the photosensitive drums 14C to 14BK.

On the other hand, in synchronization with the forming operation of a developed image in each color on the photosensitive drums 14Y to 14BK, the pickup roller 31 or a manual paper feed roller not shown in the drawing is driven, and the paper sheet P is fed from the paper feed cassette unit 30 or by manual feed, and the paper sheet P is aligned at its end by the register rollers 32 and then sent onto the transfer conveyor belt 11.

The paper sheet P sent onto the transfer conveyor belt 11 is conveyed in the direction of the arrow m in correspondence to the movement of the transfer conveyor belt 11, and at the positions of the respective transfer rollers 20Y to 20BK, a developed image by yellow toner, a developed image by cyan toner, a developed image by magenta toner, and a developed image by black toner are multiple-transferred sequentially on the paper sheet P, a full-color toner image is formed, and the paper sheet P is conveyed to the fixing unit 36, and a full-color developed image with colors superimposed is fixed permanently. Further, after fixing, the paper sheet P is ejected into the paper ejection tray 38 via the pair of paper ejection rollers 37.

On the other hand, at the time of transfer of the developed images, at the second to fourth image forming stations 12C to 12BK, a part of toner of the developed images transferred onto the paper sheet P at the image forming stations 12Y to 12M in the previous stage is reversely transferred onto the photosensitive drums.

Figure 3:
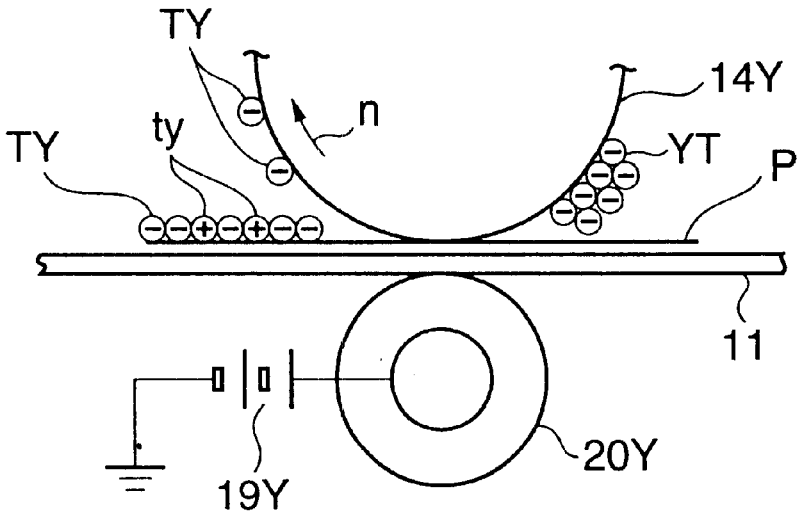
FIG. 3 is an illustration schematically showing the charging condition of toner at the first image forming station of the first embodiment of the present invention during transfer.

Next, the occurrence of reverse transfer of toner will be explained. Firstly, at the first image forming station 12Y, as shown in FIG. 3, the photosensitive drum 14Y is opposite to the transfer roller 20Y via the transfer conveyor belt 11 and the paper sheet P and at the nip thereof, the developed image composed of the toner YT of yellow (Y) on the photosensitive drum 14Y is transferred onto the paper sheet P. In this case, a charge of positive polarity from the transfer roller 20Y to which a transfer bias of positive polarity is impressed passes through the transfer conveyor belt 11 toward the paper sheet P, reverses a part of the toner YT on the paper sheet P to positive polarity, and generates toner yt of positive polarity.

Figure 4:
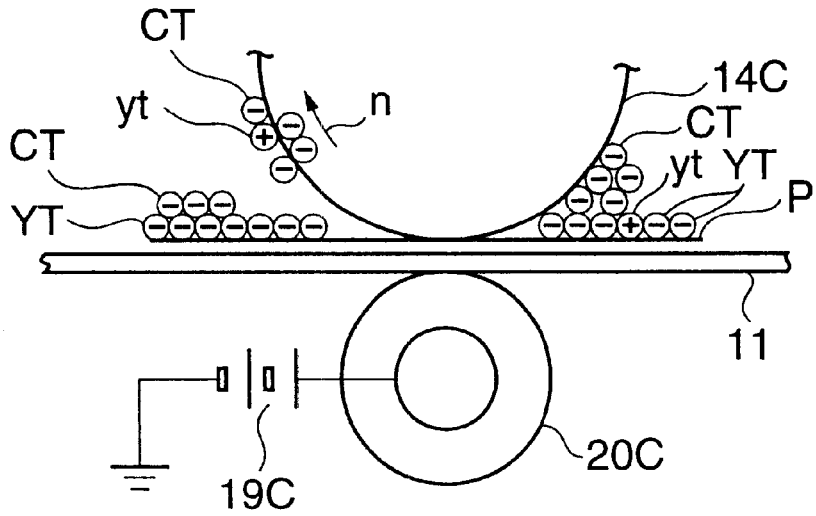
FIG. 4 is an illustration schematically showing the reverse transfer phenomenon of toner at the second image forming station of the first embodiment of the present invention.
Figure 5:
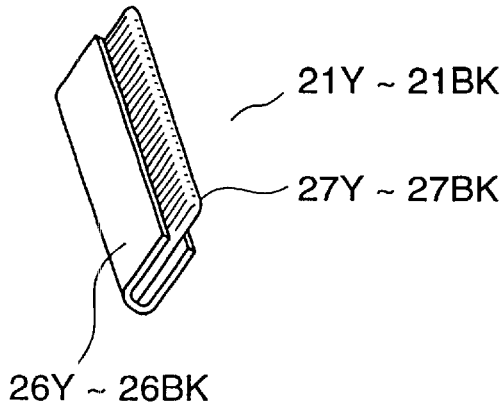
FIG. 5 is a perspective view showing the conductive brush of the first embodiment of the present invention.

Next, when the developed image having such a charging characteristic reaches the transfer position where the photosensitive drum 14C of the second image forming station 12C is opposite to the transfer roller 20, as shown in FIG. 4, the developed image composed of toner CT of cyan (C) on the photosensitive drum 14C is transferred onto the paper sheet P at the nip thereof and at the same time, the toner yt of yellow (Y) of positive polarity on the paper sheet P is electrostatically sucked in the part which is a non-exposure part of the photosensitive drum 14C and is equivalent to the white base of an image having a potential of about −600 V and reverse transfer of toner is caused.

Figure 6:
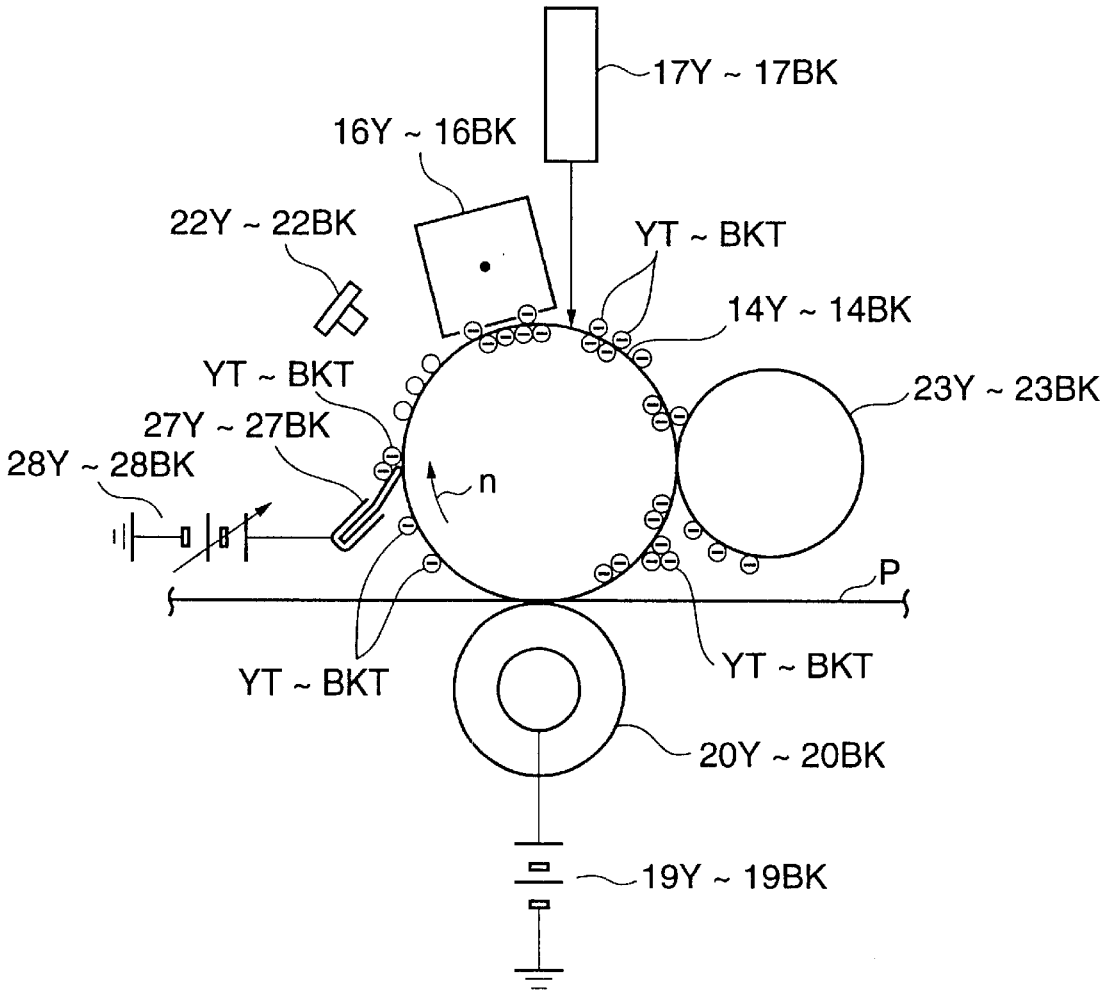

Therefore, on the photosensitive drums 14C to 14BK of the second to fourth image forming stations 12C to 12BK after end of transfer, residual toner including reverse transfer toner in a different color is adhered. When the photosensitive drums 14Y to 14BK reach the auxiliary cleaning units 21Y to 21BK respectively in such a state, as shown in FIG. 6, with respect to the residual toners YT to BKT including the reverse transfer toner on the photosensitive drums 14Y to 14BK, depending on the respective charging conditions, a part of them is sucked in the conductive brushes 27Y to 27BK to which a bias of positive polarity is impressed and the other part is formed as a thin and uniform toner layer on the photosensitive drums 14Y to 14BK by brushing. With respect to the toners YT to BKT sucked in the conductive brushes 27Y to 27BK, the charge of negative polarity is eliminated by supply of a charge of positive polarity from the conductive brushes 27Y to 27BK and electrostatically returned to the photosensitive drums 14Y to 14BK slowly.

Next, the photosensitive drums 14Y to 14BK, after the residual charges are eliminated by the discharging units 22Y to 22BK, collect the residual toner or the residual toner including the reverse transfer toner and then the next image forming process can be performed.

Namely, the photosensitive drums 14Y to 14BK are uniformly charged with about −600 V by the charging units 16Y to 16BK with the residual toner or the residual toner including the reverse transfer toner adhered. In this case, the layers of the residual toner or the residual toner including the reverse transfer toner on the photosensitive drums 14Y to 14BK are thin and uniform in thickness, so that the photosensitive drums 14Y to 14BK are charged almost uniformly. At the time of charging, the residual toner or the residual toner including the reverse transfer toner on the photosensitive drums 14Y to 14BK are given a charge of negative polarity.

Next, the exposure operation is performed on the photosensitive drums 14Y to 14BK uniformly charged by the exposure units 17Y to 17BK, and on the part irradiated with laser light, the potential of each surface of the photosensitive drums 14Y to 14BK is lowered to about −100 V, and electrostatic latent images corresponding to the image data of the respective colors are formed on the photosensitive drums 14Y to 14BK. Also in this case, the layers of the residual toner or the residual toner including the reverse transfer toner on the photosensitive drums 14Y to 14BK are thin and uniform in thickness, so that good electrostatic latent images can be formed free of noise.

Next, when the electrostatic latent image reaches the developing units 1BY to 18BK, as shown in FIG. 6, on the part with exposure light irradiated where the potential of each surface of the photosensitive drums 14Y to 14BK is lowered to about −100 V, toner of negative polarity is electrostatically fed from the developing rollers 23Y to 23BK, while on the non-exposure part having potential of about −600 V, the residual toner or the residual toner including the reverse transfer toner is collected electrostatically by the developing rollers 23Y to 23BK due to the potential difference from the developing rollers 23Y to 23BK. Namely, cleaning is executed by the developing rollers 23Y to 23BK simultaneously with development. In this way, the residual toner or the residual toner including the reverse transfer toner collected by the developing units 18Y to 18BK is recycled.

In this case, in the developing units 18C to 18BK of the second to fourth image forming stations 12C to 12BK, toner mixture is caused in the image forming stations on the upstream side by the reverse transfer toner. However, in any of the developing units 18C to 18BK, the lightness of the toners YT to MT mixed of the developing units 18Y to 18M on the upstream side is higher than the lightness of the toners CT to BKT as a base, so that for a developed image by the recycled toner, a noise due to color mixture is hardly felt by looking at and a full-color image of satisfactory display dignity is obtained.

When the residual toner is to be collected and recycled like this in the color image forming apparatus 10 of a 4-piece tandem type, by sequentially using the developers 24Y to 24BK having high lightness starting from the upstream side as developers used at the respective image forming stations 12Y to 12BK along the transfer conveyor belt 11, a combination of mixed colors with a noise hardly felt regardless of color mixture of the developers in the residual toner due to reverse transfer is obtained. Therefore, when a full-color developed image is formed, it can be seen as a satisfactory developed image having high display dignity with no noise felt by a human sense by looking at, so that recycling of residual toner provides no trouble and it can be realized.

Further, the collection process of residual toner can be executed at the same time during execution of the image forming process without executing it separately from the developed image forming process, so that another process for collection of residual toner is not necessary and image forming can be speeded up.

Further, in this embodiment, the developing rollers 23Y to 23BK of the developing units 18Y to 18BK perform both the developing function of electrostatic latent images and the collection function of residual toner, so that an exclusive device for collection of residual toner is not necessary, and the space around the photosensitive drums 14Y to 14BK can be saved, and additionally the apparatus can be made compact.

Next, the second embodiment of the present invention will be explained. The second embodiment, in place of the developing unit, which is used at each image forming station, for performing both the developing function of electrostatic latent images and the collection function of residual toner, provides an exclusive apparatus for collecting residual toner and performs the developing process of electrostatic latent images and the collection process of residual toner separately. The others are the same as those of the constitution explained in the first embodiment including the color arrangement of the developers used at the respective image forming stations, so that the same numerals are assigned to the same parts and the detailed explanation thereof will be omitted.

Namely, as shown in FIG. 7, also in the color image forming apparatus 50 of a 4-piece tandem type of this embodiment, the colors of toner used at the first to fourth image forming stations 52Y to 52BK arranged along the transfer conveyor belt 11 are yellow (Y), cyan (C), magenta (M), and black (BK) in the descending order of lightness from the upstream side.

The image forming stations 52Y to 52BK, as shown in FIG. 8, on the downstream side of the exposure units 17Y to 17BK around the photosensitive drums 14Y to 14BK, have developing rollers 53Y to 53BK to which a developing bias of about −450 V is impressed and respectively have developing unit 54Y to 54BK for housing developers 24Y to 24BK of yellow (Y), cyan (C), magenta (M), and black (BK) containing yellow (Y) toner having lightness of (88.05), cyan (C) toner having lightness of (47.76), magenta (M) toner having lightness of (46.92), and black toner having lightness of (25.11).

On the downstream side of the transfer rollers 20Y to 20BK around the photosensitive drums 14Y to 14BK, cleaning blades 56Y to 56BK which are cleaning members for removing residual toner remaining on the photosensitive drums 14Y to 14BK after transfer and cleaning units 58Y to 58BK having augers 57Y to 57BK for collecting and ejecting removed residual toner are arranged. Between the cleaning units 58Y to 58BK and the developing units 54Y to 54BK, ejection toner conveying units 61Y to 61BK having conveying augers 60Y to 60BK which are developer conveying members for conveying ejected toner ejected from the augers 57Y to 57BK to feed ports 55Y to 55BK of the developing unit 54Y to 54BK are installed. The cleaning units 58Y to 58BK and the ejected toner conveying unit 61Y to 61BK constitute collectors 62Y to 62BK.

When the image forming process is started by the color image forming apparatus 50 that the first to fourth image forming stations 52Y to 52BK are arranged sequentially like this, in the same way as with the first embodiment, electrostatic latent images are formed on the photosensitive drums 14Y to 14BK, and the toner of each color is adhered electrostatically by the developing units 54Y to 54BK, and developed images are formed.

Next, at the positions of the transfer rollers 20Y to 20BK, a developed image of each color is multiple-transferred sequentially on the paper sheet P. The paper sheet P with a full-color toner image formed is ejected into the paper ejection tray 38 after fixing.

On the other hand, after end of transfer, the residual toner on the photosensitive drum 14Y of the first image forming station 52Y or the residual toners including reverse transfer toner on the photosensitive drums 14C to 14BK of the second to fourth image forming stations 52C to 52BK are respectively scraped off and removed by the cleaning blades 56Y to 56BK and housed in the cleaning units 58Y to 58BK. Thereafter, the residual toners are collected at the ends of the cleaning units 58Y to 58BK by the augers 57Y to 57BK, ejected to the ejection toner conveying units 61Y to 61BK, conveyed and collected by the developing units 54Y to 54BK, and recycled.

By recycling of the residual toners, in the developing units 54C to 54BK of the second to fourth image forming stations 52C to 52BK, toner color mixture is caused in the image forming stations on the upstream side. However, the lightness of the toners YT to MT mixed on the upstream side is higher than the lightness of the toners CT to BKT as a base and a noise due to color mixture is hardly felt, so that a full-color developed image by the recycled toners has display dignity good to look at.

As mentioned above, the color image forming apparatus 50 of a 4-piece tandem type of this embodiment, in the same way as with the first embodiment, uses the developers 24Y to 24BK of high lightness sequentially from the upstream side along the transfer conveyor belt 11, so that at the time of recycling of the collected residual toners, a combination of color mixture that a noise due to mixture of the developers is hardly felt is obtained. Therefore, when a full-color developed image is formed, it can be seen as a satisfactory developed image having high display dignity with no noise felt by a human sense by looking at, so that recycling of the residual toners provides no trouble and it can be realized.

Further, the cleaning process of residual toner and moreover, the collection process to the developing units 52Y to 52BK can be executed at the same time during execution of the developed image forming process for the photosensitive drums 14Y to 14BK, so that image forming can be speeded up in the same way as with the first embodiment.

The present invention is not limited to the aforementioned embodiment and can be modified variously within the scope of the present invention. For example, the number and kind of colors of developers used for color image forming are not limited and even for the same color, the lightness thereof is not limited depending on the dye and pigment to be used. However, generally, in the case of yellow (Y), cyan (C), magenta (M), and black (BK), it is preferable that the lightness (L*) of yellow (Y) measured by the CIE color specification system is 86 or more, and that of cyan (C) is within the range from 50 to 66, and that of magenta (M) is within the range from 46 to 56, and that of black (BK) is 35 or less.

Further, with respect to the arrangement order of a plurality of colors, a developer with the highest lightness is arranged on the upperstream side than a developer with the lowest lightness and as long as the noise to a color developed image due to color mixture is reduced and the display dignity of the color developed image is not lowered, the developers may not be arranged always in the descending order of lightness. For example, in the first embodiment, even if the colors of developers are arranged in the order of yellow (Y), magenta (M), cyan (c), and black (BK) from the upstream side of the transfer conveyor belt 11, a noise due to color mixture is hardly felt to look at and a color developed image with high display dignity is obtained.

The charging polarity and the magnitude of a bias voltage to be impressed in the image forming process are also optional. Further, the cleaning member for removing residual toner in the second embodiment is not limited to the cleaning blades and may be a one for removing residual toner electrostatically.

As described in detail, according to the present invention, in the color image forming apparatus of a tandem type, a developer with the highest lightness is used at the image forming station on the upperstream side than a developer with the lowest lightness and moreover, developers are used at from the image forming station on the upstream side sequentially to the image forming station on the downstream side in the descending order of lightness. Therefore, when residual toner is collected and recycled, a combination of color mixture that a noise is hardly felt to look at regardless of color mixture of the developers is obtained, so that in a color developed image formed, display dignity high to look at by a human sense is obtained and even if residual toner is recycled, a substantially satisfactory image quality is obtained.

Further, according to the present invention, the collection process for recycling residual toner is executed during the process of forming a developed image, so that an exclusive operation time for the collection process is not necessary, and the image forming speed of the tandem type is not prevented from increasing though residual toner is recycled, thus a fast color image forming apparatus can be provided.

What is claimed is:

1. A color image forming apparatus comprising:

a plurality of recording medium arranged along a conveying path to form electrostatic latent images;

a plurality of developing units to feed developers to said respective electrostatic latent images formed on said plurality of recording medium and form developed images, the plurality of developing units including a first developing unit having a first developer of lightness of 86 or higher measured by a CIE color specification system, a second developing unit having a second developer of lightness of 50 to 66 measured by the CIE color specification system, a third developing unit having a third developer of lightness of 46 to 56 measured by the CIE color specification system, and a fourth developing unit having a fourth developer of lightness of 35 or lower measured by the CIE color specification system;

a plurality of transfer units to multiple-transfer said developed images formed respectively on said plurality of recording medium sequentially on a material to be transferred which is conveyed along said conveying path; and a plurality of collectors to collect respective residual developers on said plurality of recording medium after passing said transfer units in said plurality of developing units respectively, wherein said first developing unit, said second developing unit, said third developing unit, and said fourth developing unit are respectively installed in a neighborhood of said plurality of recording medium sequentially from an upstream side of said conveying path to a downstream side of said conveying path.

2. A color image forming apparatus comprising:

a plurality of recording medium arranged along a conveying path for forming electrostatic latent images;

a plurality of developing units for electrostatically feeding developers to said respective electrostatic latent images formed on said plurality of recording medium, forming developed images, and electrostatically collecting residual developers adhered to said recording medium, the plurality of developing unit including a first developing unit having a first developer of lightness of 86 or higher measured by a CIE color specification system, a second developing unit having a second developer of lightness of 50 to 66 measured by the CIE color specification system, a third developing unit having a third developer of lightness of 46 to 56 measured by the CIE color specification system, and a fourth developing unit having a fourth developer of lightness of 35 or lower measured by the CIE color specification system; and a plurality of transfer units for multiple-transferring said developed images formed respectively on said plurality of recording medium sequentially on a material to be transferred which is conveyed along said conveying path, wherein said first developing unit, said second developing unit, said third developing unit, and said fourth developing unit are respectively installed in a neighborhood of said plurality of recording medium sequentially from an upstream side of said conveying path to a downstream side of said conveying path.

3. A color image forming apparatus comprising:

a plurality of recording medium arranged along a conveying path to form electrostatic latent images;

a plurality of developing units to feed developers to said respective electrostatic latent images formed on said plurality of recording medium and form developed images, the plurality of developing units including a first developing unit having a first developer of lightness of 86 or higher measured by a CIE color specification system, a second developing unit having a second developer of lightness of 50 to 66 measured by the CIE color specification system, a third developing unit having a third developer of lightness of 46 to 56 measured by the CIE color specification system, and a fourth developing unit having a fourth developer of lightness of 35 or lower measured by the CIE color specification system;

a plurality of transfer units to multiple-transfer said developed images formed respectively on said plurality of recording medium sequentially on a material to be transferred which is conveyed along said conveying path;

cleaning members to remove respective residual developers on said plurality of recording medium after passing said transfer units, and a plurality of collectors having developer convoying members to convey said residual developers removed by said cleaning members to said plurality of developing units, wherein said first developing unit, said second developing unit, said third developing unit, and said fourth developing unit are respectively installed in a neighborhood of said plurality of recording medium sequentially from an upstream side of said conveying path to a downstream side of said conveying path.

4. A developing method for a color image forming apparatus, comprising:

a developing step of electrostatically feeding developers to electrostatic latent images formed on a plurality of recording medium arranged along a conveying path using developing members and forming developed images, the developing step including a first developing step using a first developer of lightness of 86 or higher measured by a CIE color specification system, a second developing step using a second developer of lightness of 50 to 66 measured by the CIE color specification system, a third developing step using a third developer of lightness of 46 to 56 measured by the CIE color specification system, and a fourth developing step using a fourth developer of lightness of 35 or lower measured by the CIE color specification system;

a transfer step of multiple-transferring said developed images on said plurality of recording medium sequentially on a material to be transferred which is conveyed along said conveying path; and a collection step of electrostatically collecting residual developers remaining on said plurality of recording medium using said developing members after ending of said transfer step, wherein said first developing step, said second developing step, said third developing step, and said fourth developing step are executed from an upstream side of said recording medium to a downstream side of said conveying path.

5. A developing method for a color image forming apparatus, comprising:

a developing step of electrostatically feeding developers to electrostatic latent images formed on a plurality of recording medium arranged along a conveying path using developing members and forming developed images, the developing step including a first developing step using a first developer of lightness of 86 or higher measured by a CIE color specification system, a second developing step using a second developing lightness of 50 to 66 measured by the CIE color specification system, a third developing step using a third developer of lightness of 46 to 56 measured by the CIE color specification system, and a fourth developing step using fourth developer of lightness of 35 or lower measured by the CIE color specification system;

a transfer step of multiple-transferring said developed images on said plurality of recording medium sequentially on a material to be transferred which is conveyed along said conveying path; and a collection step of removing residual developers remaining on said plurality of recording medium using cleaning members after ending of said transfer step and additionally conveying said residual developers removed toward said developing members, wherein said first developing step, said second developing step, said third developing step, and said fourth developing step are executed from an upstream side of said recording medium to a downstream side of said conveying path.

* * * * *